US007878771B2

(12) United States Patent
Okaichi et al.

(10) Patent No.: US 7,878,771 B2
(45) Date of Patent: Feb. 1, 2011

(54) HERMETIC TYPE COMPRESSOR WITH WAVE-SUPPRESSING MEMBER IN THE OIL RESERVOIR

(75) Inventors: Atsuo Okaichi, Osaka (JP); Hiroshi Hasegawa, Osaka (JP); Fumitoshi Nishiwaki, Hyogo (JP)

(73) Assignee: Panasonic Corporation, Kadoma-shi (JP)

( * ) Notice: Subject to any disclaimer, the term of this patent is extended or adjusted under 35 U.S.C. 154(b) by 566 days.

(21) Appl. No.: 10/566,273

(22) PCT Filed: Feb. 17, 2005

(86) PCT No.: PCT/JP2005/002945

§ 371 (c)(1),
(2), (4) Date: Jan. 30, 2006

(87) PCT Pub. No.: WO2005/080797

PCT Pub. Date: Sep. 1, 2005

(65) Prior Publication Data

US 2006/0192171 A1 Aug. 31, 2006

(30) Foreign Application Priority Data

Feb. 24, 2004 (JP) ..... 2004-047373
Mar. 15, 2004 (JP) ..... 2004-071964

(51) Int. Cl.
*F04B 39/02* (2006.01)

(52) U.S. Cl. ..... 417/313; 184/6.23; 418/89

(58) Field of Classification Search ..... 417/313, 417/366, 372, 423.13; 418/DIG. 1, 89; 184/6.23
See application file for complete search history.

(56) References Cited

U.S. PATENT DOCUMENTS

| | | | | |
|---|---|---|---|---|
| 4,592,703 | A * | 6/1986 | Inaba et al. | 417/366 |
| 4,755,114 | A * | 7/1988 | Shibayashi et al. | 418/55.6 |
| 5,176,506 | A * | 1/1993 | Siebel | 417/368 |
| 5,494,412 | A * | 2/1996 | Shin | 417/313 |
| 5,554,015 | A * | 9/1996 | Dreiman et al. | 417/415 |

(Continued)

FOREIGN PATENT DOCUMENTS

| | | |
|---|---|---|
| EP | 0 949 465 A | 10/1999 |
| JP | 60-69287 | 8/1985 |
| JP | 61-155692 | 7/1986 |

(Continued)

*Primary Examiner*—Devon C Kramer
*Assistant Examiner*—Philip Stimpert
(74) *Attorney, Agent, or Firm*—Kratz, Quintos & Hanson, LLP

(57) ABSTRACT

A plurality of vertically standing plates are assembled in a lattice form to a divided member 101 as a floating type wave-suppressing members. The divided member 101 is allowed to float in an interface 24 between working fluid and refrigeration oil of an oil reservoir 21. The interface 24 is prevented from rippling by turning flow, oil drops torn from the interface 24 by the turning flow is reduced, and oil drops of the refrigeration oil are prevented from being supplied from the interface 24 to the working fluid.

2 Claims, 13 Drawing Sheets

U.S. PATENT DOCUMENTS

| | | | | | |
|---|---|---|---|---|---|
| 5,582,271 | A | * | 12/1996 | Mielo | 184/6.23 |
| 5,937,817 | A | * | 8/1999 | Schanz et al. | 123/196 AB |
| 6,167,719 | B1 | * | 1/2001 | Yakumaru et al. | 62/468 |
| 6,264,448 | B1 | * | 7/2001 | Itoh et al. | 418/104 |
| 7,029,243 | B2 | * | 4/2006 | Ono | 417/313 |

FOREIGN PATENT DOCUMENTS

| | | | | |
|---|---|---|---|---|
| JP | 61-155692 | | | 12/1986 |
| JP | 7-224762 | | | 12/1995 |
| JP | 08-014179 | | | 1/1996 |
| JP | 8-14179 | | | 5/1996 |
| JP | 2000-54960 | | | 9/2000 |
| JP | 2001-182678 | | | 5/2001 |
| JP | 2002239311 | A | * | 8/2002 |
| WO | 2004/090333 | A | | 10/2004 |

* cited by examiner

HERMETIC TYPE COMPRESSOR WITH WAVE-SUPPRESSING MEMBER IN THE OIL RESERVOIR

TECHNICAL FIELD

The present invention relates to a compressor used for a refrigerator-freezer, an air conditioner and the like.

BACKGROUND TECHNIQUE

A compressor such as a rotary compressor is widely used for a refrigerator-freezer, an air conditioner and the like because it is small in size and its structure is simple. A structure of the compressor such as the rotary compressor is described in a non-patent document 1. The structure of the conventional compressor will be explained using FIG. 11 based on the rotary compressor. FIG. 11 is a vertical sectional view of the conventional rotary compressor.

The rotary compressor shown in FIG. 11 includes a container 1, a compressor mechanism disposed on a lower portion of the container 1, and a motor disposed on an upper portion of the compressor mechanism. The compressor mechanism includes a shaft 2 having an eccentric portion 2*a*, a cylinder 3, a roller 4, a vane 5, a spring 6, an upper bearing member 7 having a discharge hole 7*a*, and a lower bearing member 8.

The motor has a stator 11 which includes a coil end 11*c* and a coil end 11*d*. The stator 11 is fixed to the inside of the container 1. The motor also includes a rotor 12 fixed to a shaft 2. The stator 11 is provided at its outer periphery with a plurality of notches 11*e* serving as passages of working fluid. A gap 13 is provided between the stator 11 and the rotor 12. A lower end surface 12*a* and an upper end surface 12*b* of the rotor 12 are respectively provided with a lower balance weight 13 and an upper balance weight 14 for eliminating unbalance around the center axis L of the shaft 2. The rotor 12 is provided at its lower end surface 12*a* and upper end surface 12*b* with a lower balance weight 14 and an upper balance weigh 15 for eliminating unbalance.

The container 1 includes an introducing terminal 18, a suction pipe 19, a discharge pipe 20, and an oil reservoir 21 provided in a lower portion of the container 1 for reserving refrigeration oil.

The operation of the rotary compressor having the above-described structure will be explained.

If the stator 11 is energized through the introducing terminal 18 to rotate the rotor 12, the roller 4 is eccentrically rotated by the eccentric portion 2*a*, and a volume of a space between the cylinder 3 and the roller 4 sandwiched between an upper bearing member 7 and a lower bearing member 8 is varied. With this, the working fluid is sucked from the suction pipe 19 and is compressed. The compressed working fluid is supplied from the oil reservoir 21 and is mixed with a refrigeration oil which lubricated the compressor mechanism and in this state, the working fluid is injected into a lower space 22 of the motor through the discharge hole 7*a*.

The main flow of the injected working fluid collides against a lower end surface 12*a* of the rotor 12 and the lower balance weight 14 and then, generates a strong turning flow by the rotation of the rotor 12. A portion of oil drops mixed with the working fluid attaches to an inner wall of the container 1 by the centrifugal force or falls downward by the gravity and is separated from the working oil and returns into the oil reservoir 21 while the working fluid stays in the lower space 22 as the turning flow.

In a state in which the working fluid includes the oil drops which are not separated, the working fluid passes through the notches 11*e* and the gap 13, and is injected into an upper space 23 of the motor. The main flow of the injected working fluid flows toward the discharge pipe 20. At that time, a portion of the working fluid passes in the vicinity of an upper end surface 12*b* of the rotor 12 and the upper balance weight 15, and generates a turning flow due to the rotation of these elements. A portion of the oil drops included in the working fluid attaches to the inner wall of the container 1 by the centrifugal force while the working fluid stays in the upper space 23, or falls downward by the gravity and is separated from the working oil and returns into the oil reservoir 21 along the inner wall of the container 1 or a wall surface of the stator 11. The working fluid still including oil drops which are not yet separated from the working oil is discharged from the discharge pipe 20.

In the compressor, the working fluid and refrigeration oil which are compressed when a sliding surface of the compressor mechanism is lubricated are mixed, and a portion of the refrigeration oil reserved in the oil reservoir 21 is discharged out from the container 1 of the compressor during the process of the operation of the compressor. However, in the case of a compressor in which a large amount of refrigeration oil is discharged, since the oil level of the refrigeration oil in the oil reservoir 21 is lowered, the supply oil amount becomes insufficient, and the lubrication of the compression mechanism becomes insufficient, the reliability is deteriorated, the sealing of the compression mechanism becomes insufficient, and the efficiency of the compressor is deteriorated. Further, the refrigeration oil discharged from the compressor attaches to an inner wall of a tube of a heat exchanger to deteriorate the heat transfer coefficient between the working fluid and a wall surface in the heat exchanger tube. Thus, the performance of the refrigeration cycle is deteriorated. Therefore, the oil separating efficiency of the working fluid in the container 1 of the compressor is enhanced, and the discharging amount of the refrigeration oil is reduced.

As a structure for separating the refrigeration oil from the working fluid, there is a method to use an oil separating plate provided on an upper portion of the rotor 12 of the rotary compressor as shown in a patent document 1. FIG. 12 shows a detailed sectional view of a periphery of the oil separating plate of the conventional compressor.

The rotor 12 has an upper end plate 31*a* and a lower end plate 31*b* for closing the inserting holes of a permanent magnet 30. A plurality of through holes 12*c* are formed such as to penetrate the rotor 12 in the vertical direction. An oil separating plate 33 forms an oil separating space 32 in an upper portion of the rotor 12. The oil separating plate 33 is disposed above exits of the through holes 12*c*. The oil separating plate 33 is fixed by a fixing member 34.

In the compressor having the above-described structure, a portion of the working fluid including oil drops discharged into the lower space 21 of the motor from the compressor mechanism flows into the oil separating space 32 through the through holes 12*c* formed in the rotor 12. Here, the working fluid is discharged radially from an outer peripheral exit 32*a* of the oil separating plate 33 by the centrifugal force, and blows against the coil end 11*d* of the stator 11, and the working fluid and the refrigeration oil included in the working fluid are separated. Only the working fluid from which the refrigeration oil is separated flows upward, and is discharged out from the discharge pipe 19 provided on the upper portion of the container 1.

On the other hand, refrigeration oil attached to the coil end 11*d* of the stator 11 falls downward and returns into the oil reservoir 21 formed in the bottom of the container 1.

As a structure to prevent refrigeration oil from being mixed into the working fluid, there is a method in which an oil level stabilizing member is fixed to a bearing of the compressor as shown in patent document 2. FIG. 13 is a detailed sectional view of a periphery of the oil level stabilizing member of a conventional compressor.

That is, a disk-like oil level stabilizing member body (oil level stabilizing member) 228 is fixed to a lower surface of a bearing 225. An outer periphery of the oil level stabilizing member body 228 is formed with three holes having relatively large opening areas. Oil returns into an oil reservoir 220 through the holes. A foreign matter complementary net (oil level stabilizing member) 234 is placed on an upper surface of the outer periphery of the oil level stabilizing member body 228.

According to the compressor having such a structure, if a rotation shaft 205 is rotated, since a portion of the rotation shaft 205 is located in an oil reservoir, a centrifugal force is applied to oil in an oil reservoir tank 220. If the centrifugal force is applied to oil in the oil reservoir tank 220, a height of the oil in the vicinity of the rotation shaft 205 becomes low, and as a distance from the rotation shaft 205 becomes longer, the height of the oil becomes higher. Since the oil level stabilizing member body 228 is disposed, even if the oil level rises due to centrifugal force, the oil level is suppressed by the oil level stabilizing member body 228 and the foreign matter complementary net 234 placed on an upper surface of the body 228. Therefore, it is possible to prevent the oil level from being higher than the oil level stabilizing member body 228, and the oil level can be stabilized.

(Non-Patent Document 1)

"Air-Conditioning and Refrigeration handbook", new edition 5, volume 11, machine", Air-Conditioning and Refrigeration Institute, 1993, paragraphs 30 to 43

(Patent Document 1)

Japanese Patent Application Laid-open No. H8-28476 (paragraph 6, FIGS. 1 to 3)

(Patent Document 2)

Japanese Patent Application Laid-open No. 2003-328946 (page 6, FIGS. 1 to 4)

As described above, in the conventional compressor, the main flow of the working fluid injected into the lower space 22 of the motor from the discharge hole 7*a* of the compression mechanism collides against the lower end surface 12*a* of the rotor 12, the lower balance weight 14 and the like and then, produces a strong turning flow by the rotation of the rotor 12. At that time, an interface 24 between the working fluid and the refrigeration oil stored in the oil reservoir 21 is rippled, oil drops are torn from the interface 24 due to flow of the working fluid and is mixed into the working fluid. The oil drops supplied from the interface 24 to the working fluid increases the amount of oil drops included in the working fluid, and it becomes difficult to separate the oil drops from the working fluid.

To separate the oil drops from the working fluid, an oil separating plate shown in FIG. 12 is used. In this case, of the entire working fluid flowing from a lower space 22 to an upper space 23, this oil separating plate functions only for working fluid flowing through a through hole 12*c*, and it is impossible to separate the oil drops from the working fluid which passes through a notch 11*e* oil reservoir a gap 13. For this reason, there is a problem that a portion of the working fluid including oil drops supplied from the interface 24 passes through the notch 11*e* oil reservoir gap 13, and the oil separating plate 33 provided on an upper portion of the rotor 12 can not separate the oil drops.

To prevent refrigeration oil from being mixed into working fluid, there is a method in which an interface 24 which becomes higher as a distance from a rotation shaft 205 becomes longer due to centrifugal force caused by rotation of a rotation shaft 205 is suppressed using an oil level stabilizing member body 228 shown in FIG. 13, thereby stabilizing the interface 24. In this case, a discharging amount of refrigeration oil flowing from the compressor toward the refrigeration cycle, and a returning amount of refrigeration oil from the refrigeration cycle toward the compressor are varied and thus, the interface 24 of the compressor is always varied. Therefore, when the interface 24 is located lower than the oil level stabilizing member body 228, since the turning flow of the working fluid wields an influence on a portion below the oil level stabilizing member body 228, and there is a problem that the interface 24 is rippled by the turning flow of the working fluid, and the oil drops is torn from the interface 24 by the flow of the working fluid and is mixed into the working fluid. When the interface 24 is located higher than the oil level stabilizing member body 228, since the oil level stabilizing member body 228 is located below the interface 24 and can not exhibit its effect, there is a problem that the interface 24 is rippled by the turning flow of the working fluid, the oil drops are torn by the flow of the working fluid and the oil drops are mixed into the working fluid.

There is another method in which capacities of the lower space 22 and the upper space 23 are increased so that time during which the working fluid stays in such spaces is elongated, and separation of oil drops of refrigeration oil is facilitated by gravity. In this case, however, there is a problem the compressor is increased in size.

The above description is based on the vertical type rotary compressor, but the same is applied to the conventional scroll compressor of course. Irrespective of a difference between the vertical type and the lateral type or irrespective of a difference of the compressing manners, if the main flow working fluid passes in the vicinity of an end surface of the rotor and form a turning flow and the turning flow affects the interface while working fluid discharged from the compression mechanism is discharged from the discharge pipe provided on the container, the same problem is caused.

The above problems are generated irrespective of kinds of the working fluid, but especially when the refrigeration cycle uses a working fluid mainly comprising carbon dioxide as a main ingredient, since the pressure of the working fluid discharged from the compression chamber exceeds a critical pressure, the working fluid in the container is brought into a supercritical state, an amount of refrigeration oil solved in the working fluid is increased, and a density ratio between the working fluid and the refrigeration oil is reduced by about half as compared with conventional flon or the like. Therefore, there is a problem that it becomes more difficult to separate the oil using gravity or centrifugal force.

Therefore, the present invention has been accomplished to solve the above problems, and it is an object of the invention to provide a compressor in which oil drops is prevented from being torn from an interface between working fluid and refrigeration oil stored in an oil reservoir, an amount of refrigeration oil taken out from outside from a container is reduced, the reliability of a compressor is enhanced, and efficient refrigeration cycle can be obtained.

DISCLOSURE OF THE INVENTION

A first aspect of the present invention provides a compressor comprising a container, a compressor mechanism which is provided in the container for compressing working fluid, a motor which is provided in the container for driving the compressor mechanism, and an oil reservoir which is provided at a bottom of the container for storing refrigeration oil, wherein a wave-suppressing member is provided in an interface between the working fluid and the refrigeration oil of the oil reservoir.

With this aspect, since the wave-suppressing member is located in the interface, the rippling of the interface caused by the turning flow is reliably prevented. Thus, the oil drops torn from the interface by the turning flow is reduced, and the oil drops of the refrigeration oil are prevented from being supplied from the interface to the working fluid. That is, the amount of refrigeration oil to be taken out from the container is reduced, and efficient refrigeration cycle can be obtained.

According to a second aspect of the invention, in the compressor of the first aspect, the wave-suppressing member comprises a divided member which extends astride the interface to divide the interface into a plurality of pieces.

With this aspect, an area of each interface that comes into contact with the turning flow of the working fluid is reduced, and influence of the turning flow can be suppressed. When ripple is generated, since a portion of the divided member is immersed in the oil, shearing force is generated in the vicinity of the surface of the divided member, and the wave energy of the interface is attenuated. Therefore, rippling of the interface is suppressed, and the amount of oil discharged from the container can be reduced.

According to a third aspect of the invention, in the compressor of the second aspect, the divided member comprises a plurality of plates standing in the vertical direction.

With this aspect, since the turning flow of the working fluid is prevented from coming into direct contact with the interface, the influence of the turning flow can further be suppressed. Since the divided member can be formed with the simple structure in which the plates are disposed that they stand, the cost of the compressor can easily be reduced.

According to a fourth aspect of the invention, in the compressor of the third aspect, the plates are assembled in a lattice form.

With this aspect, the plates which are assembled in the lattice form divide the interface between the working fluid and the refrigeration oil of the oil reservoir, the periphery of the interface is completely surrounded by the plates. Therefore, the turning flow of the working fluid is more reliably prevented from coming into direct contact with the interface and thus, the influence of the turning flow can further be suppressed. Further, the lattice form structure is simple, and the cost of the divided member can easily be reduced.

According to a fifth aspect of the invention, in the compressor of the second aspect, the divided member comprises a honeycomb member.

With this aspect, since the interface between the refrigeration oil and the working fluid is divided by the honeycomb member, the interface is located in the honeycomb member. This prevents the turning flow of the working fluid from coming into direct contact with the interfaces and thus, the influence of the turning flow can largely be suppressed. Further, since the divided member comprises the honeycomb member, the refrigeration oil which is returned to the oil reservoir from above can smoothly be introduced into the oil reservoir.

According to a sixth aspect of the invention, in the compressor of the first aspect, the wave-suppressing member comprises a porous member extending astride the interface.

With this aspect, since the porous member is located in the interface between the refrigeration oil and the working fluid, the interface is located in the porous member. Thus, it is possible to prevent the turning flow of working fluid from coming into direct contact with the interface, and the influence of the turning flow can largely be suppressed.

According to a seventh aspect of the invention, in the compressor of the first aspect, the wave-suppressing member comprises a mesh member extending astride the interface.

With this aspect, since the mesh member is located in the interface between the refrigeration oil and the working fluid, the interface is located in the mesh member. Thus, it is possible to prevent the turning flow of working fluid from coming into direct contact with the interface, and the influence of the turning flow can largely be suppressed.

According to an eighth aspect of the invention, in the compressor of the seventh aspect, the mesh member comprises a fibrous mesh member.

With this aspect, in the fibrous mesh member, fibrous meshes are three-dimensionally intertwined with each other in a complicated manner, and it is possible to suppress the rippling of the interface effectively irrespective of kinds of ripple such as vertical ripple and lateral ripple.

According to a ninth aspect of the invention, in the compressor of any one of second to fifth aspects, the mesh member is disposed in a divided portion divided by the divided member.

With this aspect, since the mesh member is located in the interface between the refrigeration oil and the working fluid, the interface is located in the mesh member. Thus, it is possible to prevent the turning flow of working fluid from coming into direct contact with the interface, and the influence of the turning flow can largely be suppressed.

According to a tenth aspect of the invention, in the compressor of the first aspect, the wave-suppressing member comprises a plate member extending astride the interface.

With this aspect, since there is the plate member in the interface, the area of the interface that comes into contact with the turning flow of the working fluid is reduced, and the influence of the turning flow can be suppressed. When ripple is generated, the plate member holds the interface down, and the wave energy of the interface is changed into the vertical motion of the plate member. Thus, the ripple of the interface is suppressed, the oil drops torn from the interface by the turning flow are reduced, and the oil drops of the refrigeration oil are prevented from being supplied from the interface to the working fluid.

According to an eleventh aspect of the invention, in the compressor of any one of the first to tenth aspects, the wave-suppressing member comprises a floating type wave-suppressing member.

With this aspect, since the floating type wave-suppressing member floats in the interface, even if the interface is vertically moved, the wave-suppressing member follows such motion, and ripple of the interface caused by the turning flow is reliably suppressed. Thus, the oil drops torn from the interface by the turning flow are reduced, and the oil drops of the refrigeration oil are prevented from being supplied from the interface to the working fluid. That is, the amount of refrigeration oil to be taken out from the container is reduced, the reliability of the compressor is enhanced, and efficient refrigeration cycle can be obtained.

According to a twelfth aspect of the invention, in the compressor of any one of the first to eleventh aspects, bulk density of the floating type wave-suppressing members is set greater than density of the working fluid and smaller than density of the refrigeration oil.

With this aspect, since the floating type wave-suppressing member is always located in the interface between the working fluid and the refrigeration oil of the oil reservoir the ripple-preventing effect of the interface can always be exhibited.

According to a thirteenth aspect of the invention, in the compressor of any one of the first to twelfth aspects, the working fluid is carbon dioxide.

With this aspect, ripple of the interface is prevented and the amount of oil to be discharged can be reduced. Therefore, carbon dioxide as environmentally friendly refrigerant can be used.

BEST MODE FOR CARRYING OUT THE INVENTION

First Embodiment

Figure 1:
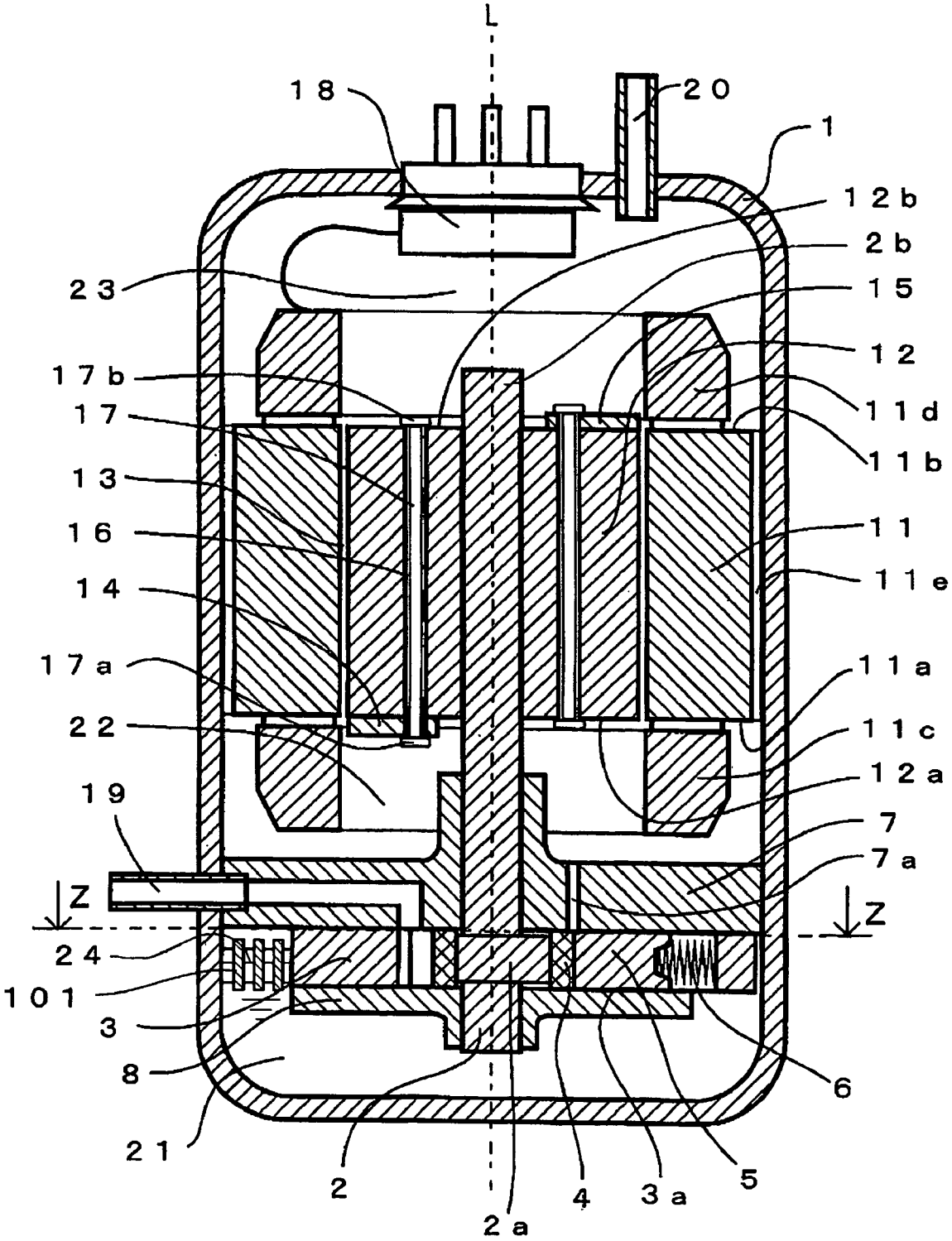
FIG. 1 is a vertical sectional view of a rotary compressor according to a first embodiment of the present invention.
Figure 2:
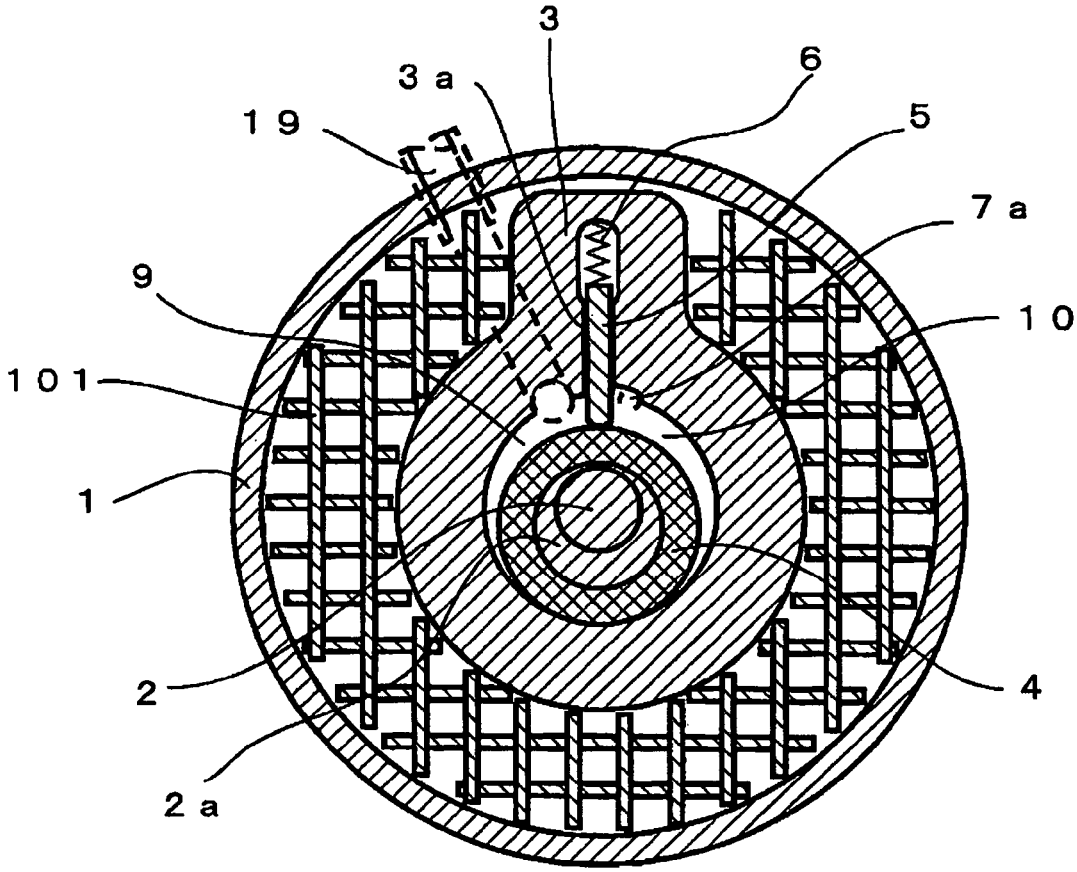
FIG. 2 is a transverse sectional view of the rotary compressor shown in FIG. 1 taken along the arrows Z-Z.
Figure 11:
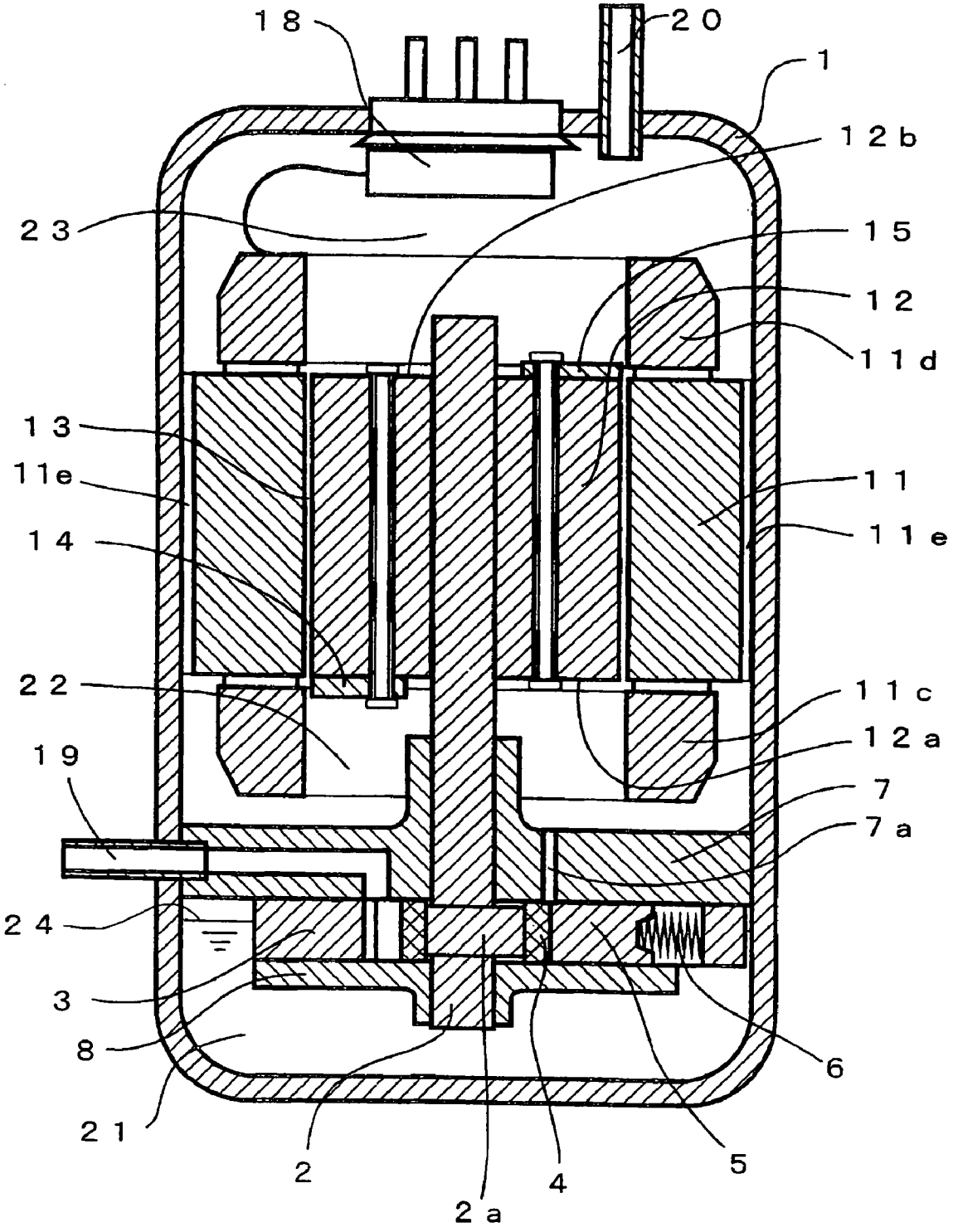
Fig. 11 RELATED ART
FIG. 11 is a vertical sectional view of a conventional rotary compressor.
Figure 12:
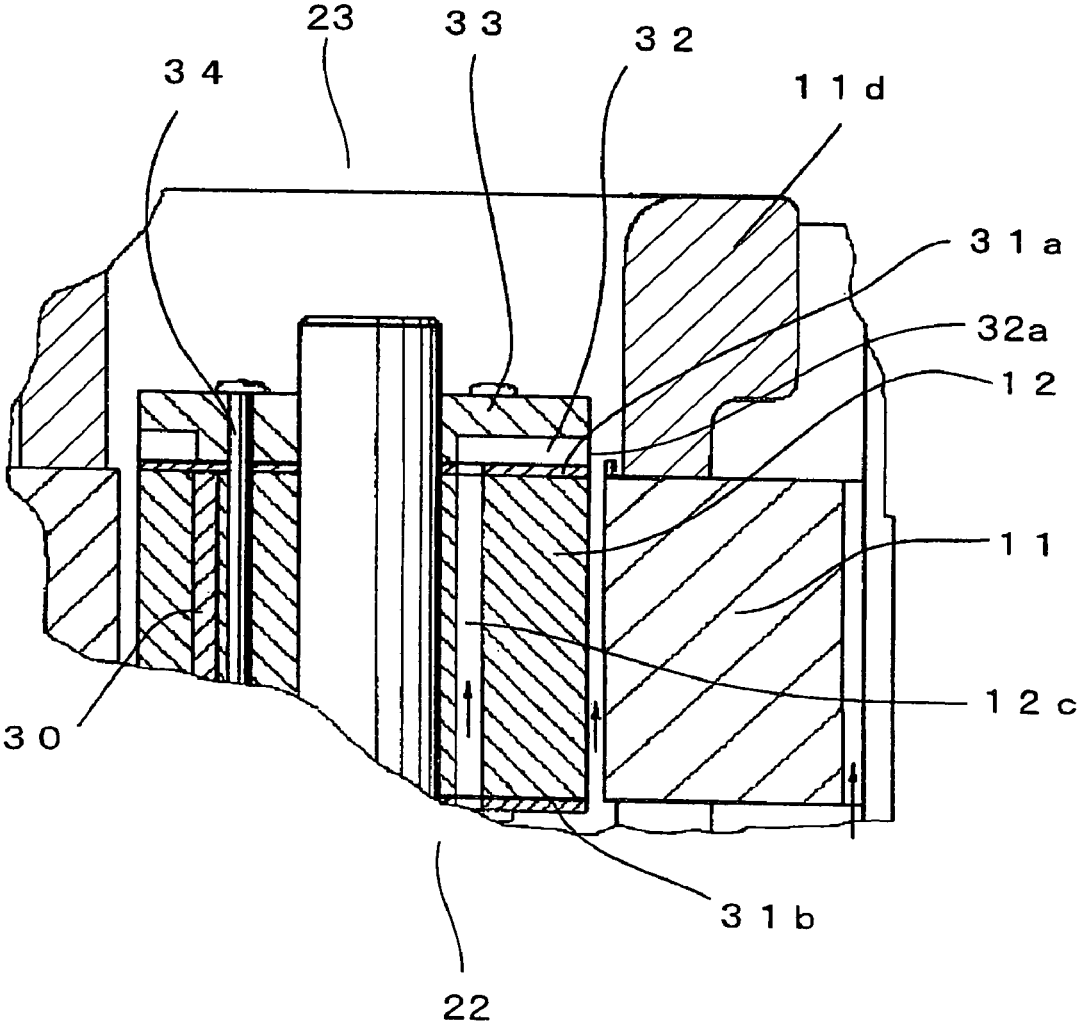
Fig. 12 RELATED ART
FIG. 12 is a detailed sectional view of a periphery of an oil separating plate of a conventional compressor.
Figure 13:
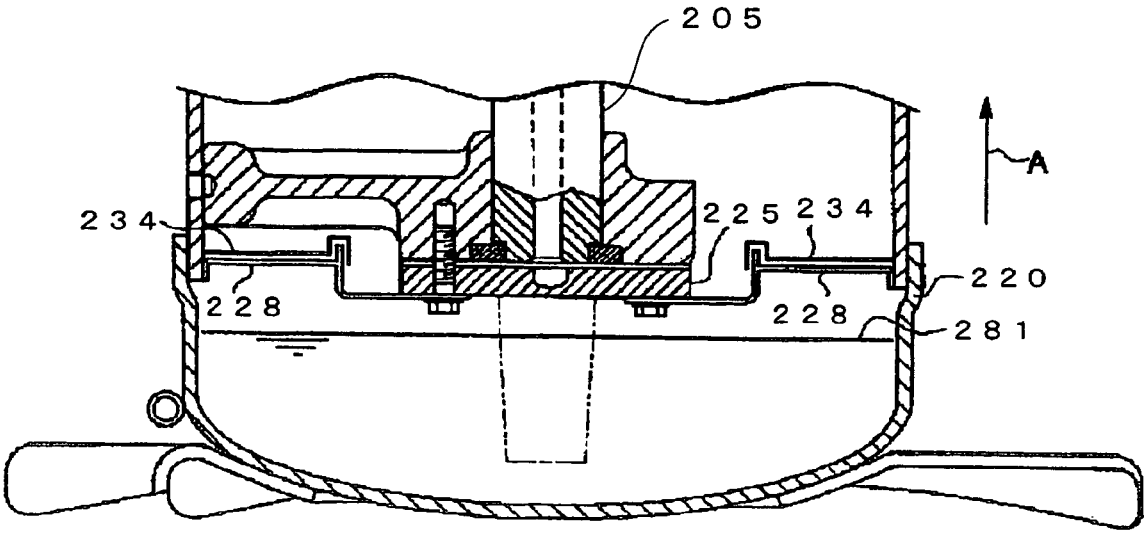
Fig. 13 RELATED ART
FIG. 13 is a detailed sectional view of a periphery of an oil level stabilizing member of a conventional compressor.

A compressor of a first embodiment of the present invention is a rotary compressor, and has substantially the same structure as that of the conventional rotary compressor explained using FIG. 11, and the same elements are designated with the same symbols. FIG. 1 is a vertical sectional view of a rotary compressor according to a first embodiment of the present invention. FIG. 2 is a transverse sectional view of the rotary compressor shown in FIG. 1 taken along the arrows Z-Z.

The rotary compressor of this embodiment includes a container 1, a compressor mechanism disposed in a lower portion of the container 1, and a motor disposed in an upper portion of the compressor mechanism.

The compressor mechanism includes a shaft 2 which has an eccentric portion 2*a* and which rotates around a center axis L, a cylinder 3, a roller 4 which is fitted into the eccentric portion 2*a* of the shaft 2 and which eccentrically rotates in the cylinder 3 when the shaft 2 rotates, a vane 5 which reciprocates in a vane groove 3*a* of the cylinder 3 in a state in which a tip end of the vane 5 is in contact with the roller 4, a spring 6 for biasing the vane 5 against the roller 4, an upper bearing member 7 which includes a discharge hole 7*a* and which supports the shaft 2 above the cylinder 3, and a lower bearing member 8 which supports the shaft 2 below the cylinder 3. A suction chamber 9 and a compression chamber 10 are formed in a space between the cylinder 3 and the roller 4 sandwiched between the upper bearing member 7 and the lower bearing member 8.

The motor includes a stator 11 which has a coil end 11*c* and a coil end 11*d* projecting from a lower end surface 11*a* and an upper end surface 11*b* and which is fixed in the container 1, and a rotor 12 fixed to the shaft 2. The stator 11 is provided at its outer periphery with a plurality of notches 11*e* serving as passages of working fluid, and a gap 13 is provided between the stator 11 and the rotor 12.

A lower end surface 12*a* and an upper end surface 12*b* of the rotor 12 are provided with a lower balance weight 14 and an upper balance weight 15 for eliminating unbalance around the center axis L of the shaft 2. The lower balance weight 14, the rotor 12 and the upper balance weight 15 are provided with communication holes 16 which bring the lower balance weight 14, the rotor 12, the upper balance weight 15 and the rotor 12 into communication with each other. Rivets 17 are inserted through the communication holes 16 and both ends of the communication holes 16 are swaged to fix the lower balance weight 14, the rotor 12 and the upper balance weight 15.

The container 1 includes an introducing terminal 18 for energizing the stator 11, a suction pipe 19 for introducing the working fluid into the suction chamber 9, a discharge pipe 20 for discharging the working fluid out from the container 1, and an oil reservoir 21 provided in a lower portion of the container 1 for reserving refrigeration oil.

As compared with the conventional rotary compressor shown in FIG. 11, the rotary compressor of this embodiment is characterized in that a divided member 101 floats in an interface 24 between refrigeration oil and working fluid accumulated in the oil reservoir 21. The divided member 101 comprises a plurality of plates standing in the vertical direction (direction perpendicular to the interface 24) which are assembled in a lattice form as floating type wave-suppressing members.

The divided member 101 comprises the plurality of plates standing in the vertical direction which are assembled in the lattice form. The divided member 101 has bulk density greater than density of the working fluid and smaller than density of the refrigeration oil so that the divided member 101 floats in the interface 24. The interface 24 is divided into a plurality of pieces by the divided member 101.

The operation of the rotary compressor having the above-described structure will be explained.

If the stator 11 is energized through the introducing terminal 18 to rotate the rotor 12, the roller 4 is eccentrically rotated by the eccentric portion 2*a*, and volumes of the suction chamber 9 and the compression chamber 10 are varied. With this, the working fluid is sucked into the suction chamber 9 from the suction pipe 19 and is compressed in the compression chamber 10. The compressed working fluid is supplied from the oil reservoir 21 and is mixed with oil drops of refrigeration oil which lubricated the compressor mechanism and in this state, the working fluid is injected into a lower space 22 of the motor through the discharge hole 7*a*.

The main flow of the injected working fluid collides against a lower end surface 12*a* of the rotor 12, the lower balance weight 14 and a lower end 17*a* of the rivet 17 and then, generates a strong turning flow by the rotation of the rotor 12. A portion of oil drops mixed with the working fluid attaches to an inner wall of the container 1 by the centrifugal force or falls downward by the gravity and is separated from the working fluid and returns into the oil reservoir 21 while the working fluid stays in the lower space 22 as the turning flow.

On the other hand, the working fluid passes through the notch 11*e* and the gap 13 in a state in which the working fluid includes oil drops which are not yet separated, and is injected into the upper space 23 of the motor. The main flow of the injected working fluid flows toward the discharge pipe 20. At that time, a portion of working fluid passes in the vicinity of the upper end surface 12*b* of the rotor 12, the upper balance weight 15, an upper end 17*b* of the rivet 17 and a shaft projection 2*b* projecting from the upper end surface 12*b*, and becomes a turning flow due to influence of the rotation. A portion of the oil drops included in the working fluid attaches to the inner wall of the container 1 by the centrifugal force or falls downward by the gravity and is separated from the working oil and returns into the oil reservoir 21 along the inner wall of the container 1 or along the wall surface of the stator 11 while the working fluid stays in the upper space 23. And in a state in which the working fluid includes oil drops which are not yet separated from the working fluid, the working fluid is discharged from the discharge pipe 20.

According to the compressor of the first embodiment having the above structure, as the rotor 12 rotates, the turning flow of the working fluid is generated in the lower space 22, but since the interface 24 between the working fluid and the refrigeration oil in the oil reservoir 21 is provided with the floating type wave-suppressing members, the floating type wave-suppressing members suppress the rippling of the interface 24 caused by the turning flow, the oil drops torn from the interface 24 by the turning flow are reduced, and oil drops of the refrigeration oil are prevented from being supplied to the working fluid from the interface 24. Therefore, oil drops of refrigeration oil to be separated from the working fluid are reduced, and the oil discharging amount to be discharged from the container 1 can be reduced.

The divided member 101 floats in the interface 24 between the working fluid and the refrigeration oil of the oil reservoir 21. The floating type wave-suppressing member comprises the divided member 101 which divides the interface 24 into the plurality of pieces. Each area of the interface 24 which comes into contact with the turning flow of the working fluid is reduced, and the influence of the turning flow can be suppressed.

When the ripple is generated, since a portion of the divided member 101 is immersed in the oil, a shearing force is generated in the vicinity of the surface of the divided member 101, and the wave energy of the interface 24 is attenuated. With this, the ripple of the interface 24 is further suppressed, the oil drops torn from the interface 24 is reduced, and it is possible to prevent the oil drops of the refrigeration oil from being supplied to the working fluid. Therefore, oil drops of refrigeration oil to be separated from the working fluid are reduced, and the oil discharging amount to be discharged from the container 1 can be reduced.

The divided member 101 floats in the interface 24. The divided member 101 comprises the plurality of standing plates in the vertical direction. Thus, the area of the interface 24 which comes into contact with the turning flow of the working fluid is reduced, it is possible to prevent the turning flow of the working fluid from coming into direct contact with the interface 24 and thus, it is possible to prevent the turning flow from rippling the interface 24.

When ripple is generated, since a portion of the plate is immersed in the oil, the shearing force is generated in the vicinity of the surface of the plate, and the wave energy of the interface 24 is attenuated. Thus, the ripple of the oil reservoir 21 is further suppressed, and the oil drops to be torn from the interface 24 by the turning flow can be reduced. With this, it is possible to prevent the oil drops of the refrigeration oil from being supplied to the working fluid from the interface 24, oil drops of refrigeration oil to be separated from the working fluid are reduced, and the oil discharging amount to be discharged from the container 1 can be reduced.

The divided member 101 is disposed such that it stands in the vertical direction, and the interface 24 is divided by the divided member 101. Thus, a cost thereof can easily be reduced.

To constitute the divided member 101, since the plurality of plates are assembled in the lattice form, the interface 24 is completely surrounded by the plates. Therefore, the each area of the interface 24 which comes into contact with the turning flow of the working fluid is reduced, it is possible to more reliably prevent the turning flow of the working fluid from coming into direct contact with the interface 24 and thus, it is possible to further suppress the influence of the turning flow.

When the ripple is generated, since a portion of the plates which are assembled in the lattice form is immersed in the oil, the shearing force is generated in the vicinity of the surface of the plate, and the wave energy of the interface 24 is attenuated. Therefore, the ripple of the oil reservoir 21 can more reliably be suppressed, and the oil drops to be torn from the interface 24 by the turning flow can be reduced. With this, it is possible to prevent the oil drops of the refrigeration oil from being supplied from the interface 24 to the working fluid, oil drops of refrigeration oil to be separated from the working fluid are reduced, and the oil discharging amount to be discharged from the container 1 can be reduced more reliably.

The divided member 101 comprises the standing plates which are assembled in the lattice form, and the interface 24 can be divided by the divided member 101, the interface 24 can completely be surrounded and thus, a cost thereof can easily be reduced.

The divided member 101 has the bulk density greater than density of the working fluid and smaller than density of the refrigeration oil of the oil reservoir 21 so that a portion of the divided member 101 is always immersed in the refrigeration oil of the oil reservoir 21 and is located in the interface 24. Therefore, the ripple-preventing effect of the divided member 101 with respect to the interface 24 can always be exhibited. Generally, the density of the working fluid in the container 1 is varied depending upon the pressure and the temperature in the container 1, but if the variation range of the density of the working fluid is taken into account, the divided member 101 can always be located in the interface 24.

The vertical rotary compressor is explained in this embodiment, but irrespective of the difference between the vertical type and the lateral type, or irrespective of the difference of compressing manners, if the main flow of the working fluid discharged from the compressor mechanism passes in the vicinity of the rotor before the working fluid is discharged from the discharge pipe, the same effect can be obtained of course.

Second Embodiment

A compressor of a second embodiment of the present invention is substantially the same as the rotary compressor of the first embodiment explained with reference to FIGS. 1 and 2, and the same elements are designated with the same symbols. Explanation of the same structure and its operation will be omitted.

Figure 3:
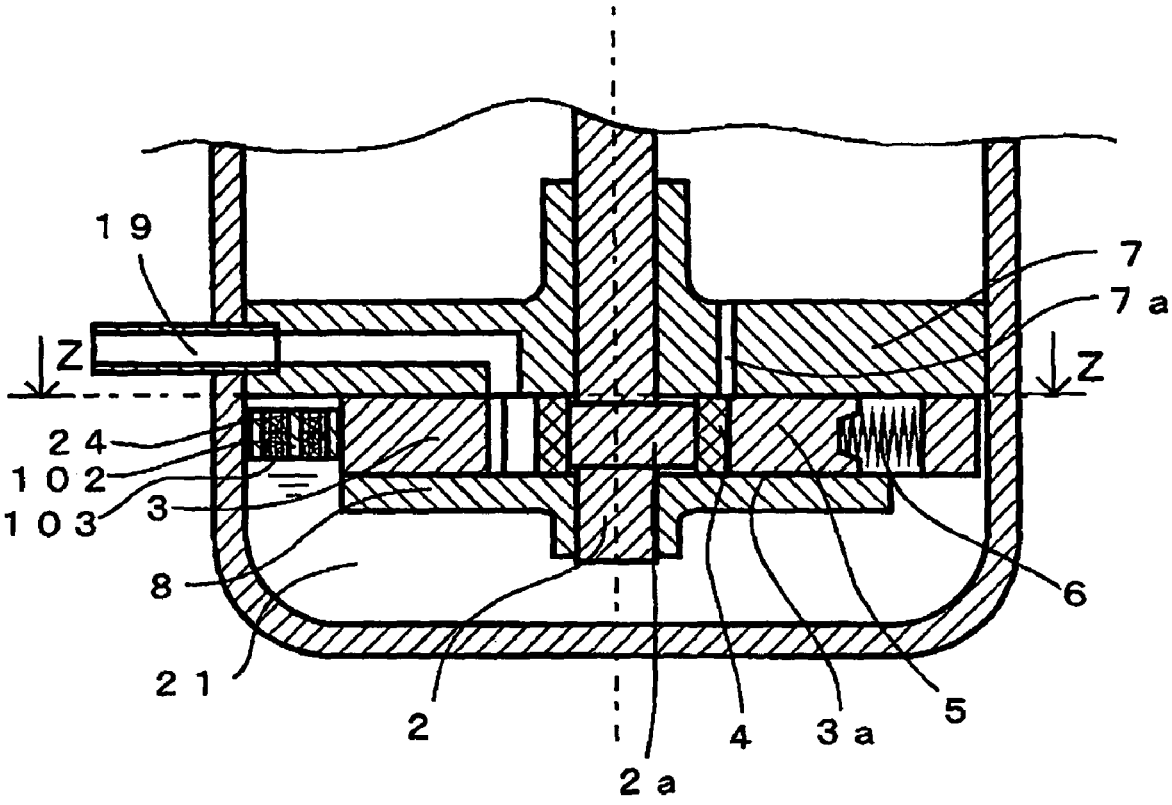
FIG. 3 is a vertical sectional view of an oil reservoir and its periphery of a refrigeration cycle of a second embodiment of the invention.
Figure 4:
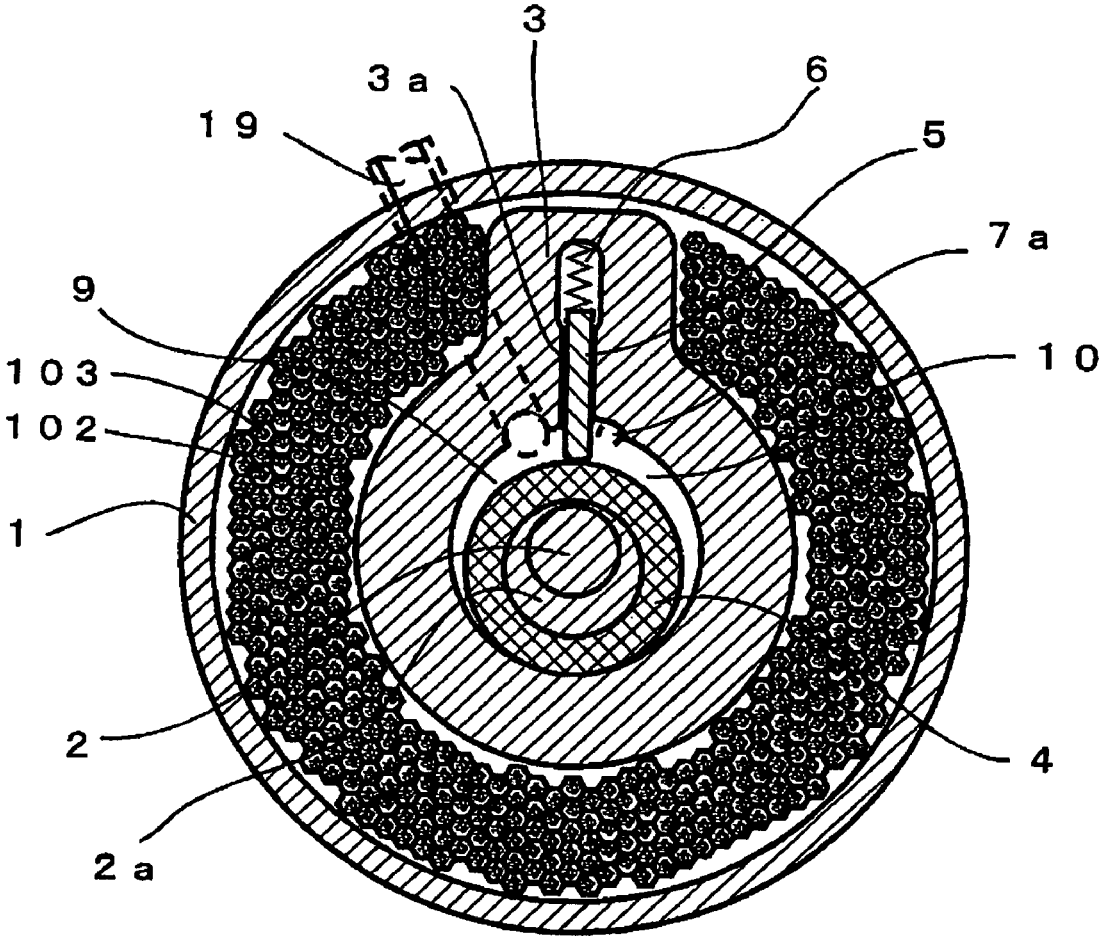
FIG. 4 is a transverse sectional view of the rotary compressor shown in FIG. 3 taken along the arrows Z-Z.

FIG. 3 is a vertical sectional view of an oil reservoir and its periphery of a refrigeration cycle of a second embodiment of the invention. FIG. 4 is a transverse sectional view of the rotary compressor shown in FIG. 3 taken along the arrows Z-Z.

The rotary compressor of the second embodiment is different from that of the first embodiment in that honeycomb members 102 float as the divided member in the interface 24 between the working fluid and the refrigeration oil of the oil reservoir 21, and mesh members 103 are inserted into and fixed to the plurality of vertical holes of the honeycomb members 102.

That is, the bulk densities of the honeycomb member 102 and the mesh member 103 are greater than the density of the working fluid and smaller than the density of the refrigeration oil, and the honeycomb members 102 and the mesh members 103 float astride the interface 24 between the refrigeration oil and the working fluid. The interface 24 is divided into a plurality of pieces by the vertical holes of the honeycomb members 102.

The operation of the rotary compressor having the above structure will be explained.

The main flow of working fluid which injected into the lower space 22 collides against the lower end surface 12*a* of the rotor 12, the lower balance weight 14 and a lower end 17*a* of the rivet 17 and then, generates a strong turning flow by the rotation of the rotor 12. A portion of oil drops mixed with the working fluid attaches to an inner wall of the container 1 due to the centrifugal force or falls downward by the gravity and is separated from the working fluid, and returns to the oil reservoir 21 while the working fluid stays in the lower space 22 as the turning flow.

On the other hand, the working fluid passes through the notch 11*e* and the gap 13 in a state in which the working fluid includes oil drops which are not yet separated, and is injected into the upper space 23 of the motor. The main flow of the injected working fluid flows toward the discharge pipe 20. At that time, a portion of working fluid passes in the vicinity of the upper end surface 12*b* of the rotor 12, the upper balance weight 15, an upper end 17*b* of the rivet 17 and a shaft projection 2*b* projecting from the upper end surface 12*b*, and becomes a turning flow due to influence of the rotation. A portion of the oil drops included in the working fluid attaches to the inner wall of the container 1 by the centrifugal force or falls downward by the gravity and is separated from the working oil and returns into the oil reservoir 21 along the inner wall of the container 1 or along the wall surface of the stator 11 while the working fluid stays in the upper space 23. And in a state in which the working fluid includes oil drops which are not yet separated from the working fluid, the working fluid is discharged from the discharge pipe 20.

According to the compressor of the second embodiment having the above structure, as the rotor 12 rotates, the turning flow of the working fluid is generated in the lower space 22. However, since the honeycomb members 102 are disposed as the divided member in the interface 24 between the refrigeration oil and the working fluid and the interface 24 is divided by the honeycomb members 102, the interface 24 is located in the honeycomb members 102. Thus, an area of each interface 24 which comes into contact with the turning flow of the working fluid is reduced, the turning flow of the working fluid is prevented from coming into direct contact with the interface 24 and thus, the influence of the turning flow can largely be suppressed.

When ripple is generated, since a portion of the honeycomb member 102 is immersed in the oil, the shearing force is generated in the vicinity of the surface of the honeycomb member 102, and the wave energy of the interface 24 is attenuated. Thus, the ripple of the oil reservoir 21 is suppressed, and the oil drops to be torn from the interface 24 by the turning flow can be reduced. With this, it is possible to prevent the oil drops of the refrigeration oil from being supplied to the working fluid from the interface 24, oil drops of refrigeration oil to be separated from the working fluid are reduced, and the oil discharging amount to be discharged from the container 1 can be reduced.

Since the honeycomb member 102 is provided as the divided member, the honeycomb-like vertical holes function as guides, and refrigeration oil returning to the oil reservoir from above can smoothly be introduced into the oil reservoir.

Since the mesh members 103 are disposed in the vertical holes as divided portions divided by the honeycomb members 102, the mesh members 103 are located in the interface 24 between the refrigeration oil and the working fluid of the oil reservoir 21, and the interface 24 is located in the mesh members 103. Thus, the interface 24 does not directly face the turning flow of the working fluid and the influence of the turning flow can more effectively be suppressed.

When the ripple is generated, since portions of the honeycomb member 102 and the mesh member 103 are immersed in the oil, the shearing force is generated in the vicinity of the surfaces of the honeycomb member 102 and the mesh member 103, and the wave energy of the interface 24 is attenuated. Thus, the ripple of the oil reservoir 21 is suppressed, the oil drops to be torn from the interface 24 by the turning flow are reduced, and the oil drops of the refrigeration oil are prevented from being supplied from the interface 24 to the working fluid. Therefore, oil drops of refrigeration oil to be separated from the working fluid are reduced, and the oil discharging amount to be discharged from the container 1 can be reduced.

Further, since the mesh member 103 is held by the honeycomb member 102, the mesh member 103 is less prone to be deformed, and even if the mesh member 103 is used for a long term, its initial performance can be maintained.

The honeycomb member 102 and the mesh member 103 have the bulk densities greater than density of the working fluid and smaller than density of the refrigeration oil of the oil reservoir 21 so that portions of the honeycomb member 102 and the mesh member 103 are always immersed in the refrigeration oil of the oil reservoir 21 and are located in the interface 24. Therefore, the ripple-preventing effect of the interface 24 can always be exhibited. Generally, the density of the working fluid in the container 1 is varied depending upon the pressure and the temperature in the container 1, but if the variation range of the density of the working fluid is taken into account, the honeycomb member 102 and the mesh member 103 can always be located in the interface 24.

The mesh member 103 of this embodiment may be metal mesh member, and it is only necessary that the mesh member has such a bulk density that the mesh member 103 can float in the interface 24 in a state in which the mesh member 103 is inserted into the honeycomb member 102.

Third Embodiment

A compressor of a third embodiment of the present invention is substantially the same as the rotary compressors of the first and second embodiments, and the same elements are designated with the same symbols. Explanation of the same structure and its operation will be omitted.

Figure 5:
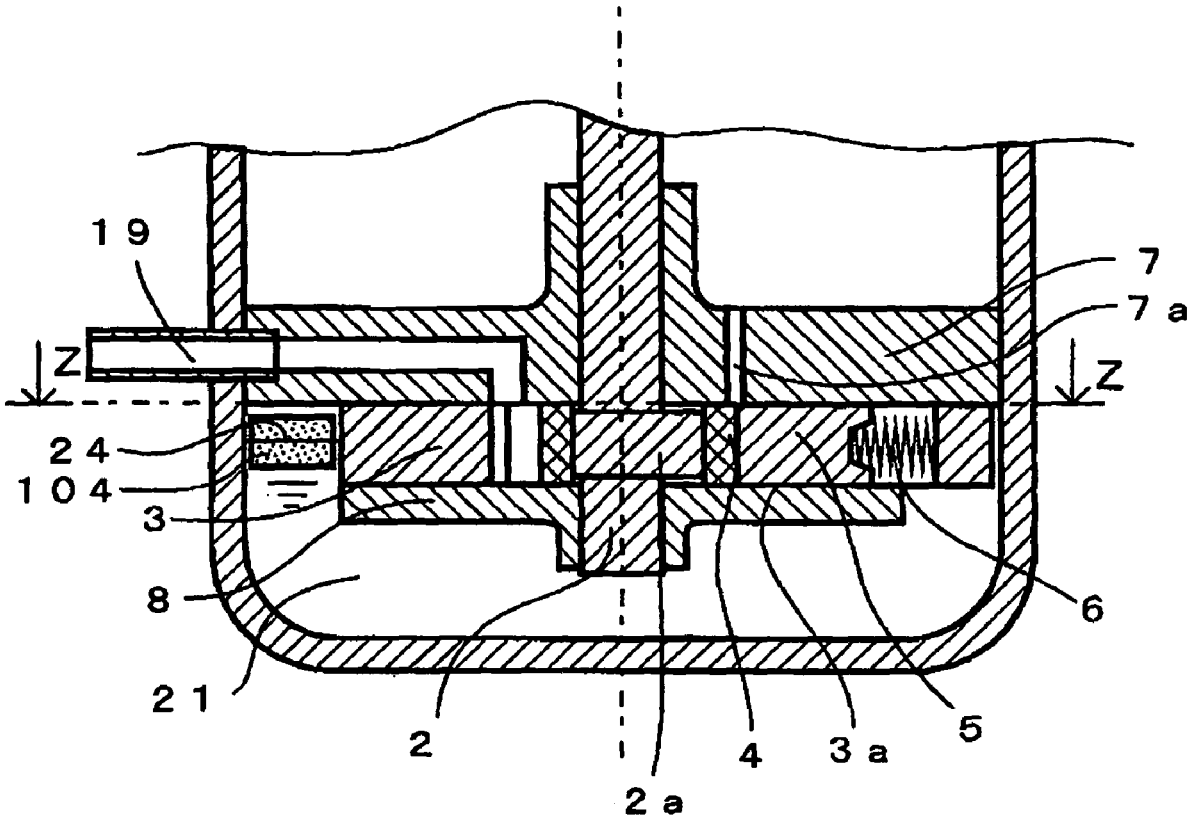
FIG. 5 is a vertical sectional view of an oil reservoir and its periphery of a refrigeration cycle of a third embodiment of the invention.
Figure 6:
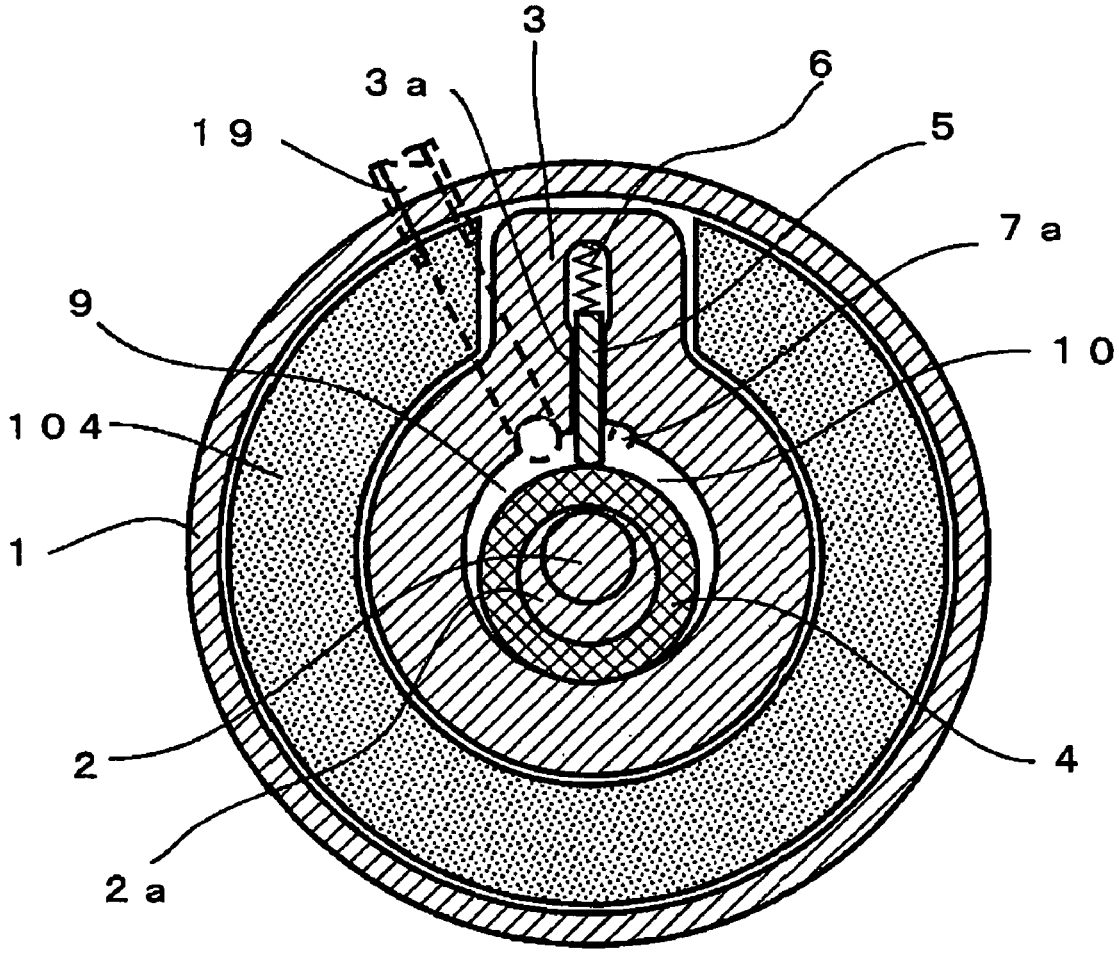
FIG. 6 is a transverse sectional view of the rotary compressor shown in FIG. 5 taken along the arrows Z-Z.

FIG. 5 is a vertical sectional view of an oil reservoir and its periphery of a refrigeration cycle of a third embodiment of the invention. FIG. 6 is a transverse sectional view of the rotary compressor shown in FIG. 5 taken along the arrows Z-Z.

The rotary compressor of this embodiment is different from that of the first embodiment in that a porous member 104 floats as the floating type wave-suppressing members in the interface 24 between the working fluid and the refrigeration oil of the oil reservoir 21. That is, the bulk density of the porous member 104 is greater than the density of the working fluid and smaller than the density of the refrigeration oil, the porous member 104 floats astride the interface 24, and the interface 24 is located in the porous member 104.

The operation of the rotary compressor having the above structure will be explained.

The main flow of working fluid which injected into the lower space 22 collides against the lower end surface 12*a* of the rotor 12, the lower balance weight 14 and a lower end 17*a* of the rivet 17 and then, generates a strong turning flow by the rotation of the rotor 12. A portion of oil drops mixed with the working fluid attaches to an inner wall of the container 1 due to the centrifugal force or falls downward by the gravity and is separated from the working fluid, and returns to the oil reservoir 21 while the working fluid stays in the lower space 22 as the turning flow.

On the other hand, the working fluid passes through the notch 11*e* and the gap 13 in a state in which the working fluid includes oil drops which are not yet separated, and is injected into the upper space 23 of the motor. The main flow of the injected working fluid flows toward the discharge pipe 20. At that time, a portion of working fluid passes in the vicinity of the upper end surface 12*b* of the rotor 12, the upper balance weight 15, an upper end 17*b* of the rivet 17 and a shaft projection 2*b* projecting from the upper end surface 12*b*, and becomes a turning flow due to influence of the rotation. A portion of the oil drops included in the working fluid attaches to the inner wall of the container 1 by the centrifugal force or falls downward by the gravity and is separated from the working oil and returns into the oil reservoir 21 along the inner wall of the container 1 or along the wall surface of the stator 11 while the working fluid stays in the upper space 23. And in a state in which the working fluid includes oil drops which are not yet separated from the working fluid, the working fluid is discharged from the discharge pipe 20.

According to the compressor of the third embodiment having such a structure, as the rotor 12 rotates, a turning flow of the working fluid is generated in the lower space 22. However, the porous member 104 is disposed as the floating type wave-suppressing members in the interface 24 between the refrigeration oil and the working fluid and the interface 24 is located in the porous member 104. Therefore, the turning flow of the working fluid is prevented from directly coming into contact with the interface 24 and thus, the influence of the turning flow can largely be suppressed.

When ripple is generated, since a portion of the porous member 104 is immersed in the oil, the shearing force is generated in the vicinity of the surface of the porous member 104, and the wave energy of the interface 24 is attenuated. Thus, the ripple of the oil reservoir 21 is suppressed, and the oil drops to be torn from the interface 24 by the turning flow can be reduced. With this, it is possible to prevent the oil drops of the refrigeration oil from being supplied to the working fluid from the interface 24, oil drops of refrigeration oil to be separated from the working fluid are reduced, and the oil discharging amount to be discharged from the container 1 can be reduced.

Since the porous member 104 is used as the floating type wave-suppressing members, a surface area of the floating type wave-suppressing members with which the refrigeration oil of the oil reservoir 21 comes into contact is increased as compared with the divided member, and the wave-suppressing effect due to viscosity is enhanced.

The porous member 104 has the bulk densities greater than density of the working fluid and smaller than density of the refrigeration oil of the oil reservoir 21 so that a portion of the porous member 104 is always immersed in the refrigeration oil of the oil reservoir 21 and is located in the interface 24. Therefore, the ripple-preventing effect of the interface 24 can always be exhibited. Generally, the density of the working fluid in the container 1 is varied depending upon the pressure and the temperature in the container 1, but if the variation range of the density of the working fluid is taken into account, the porous member 104 can always be located in the interface 24.

Fourth Embodiment

A compressor of a fourth embodiment of the present invention is substantially the same as the rotary compressors of the first to third embodiments, and the same elements are designated with the same symbols. Explanation of the same structure and its operation will be omitted.

Figure 7:
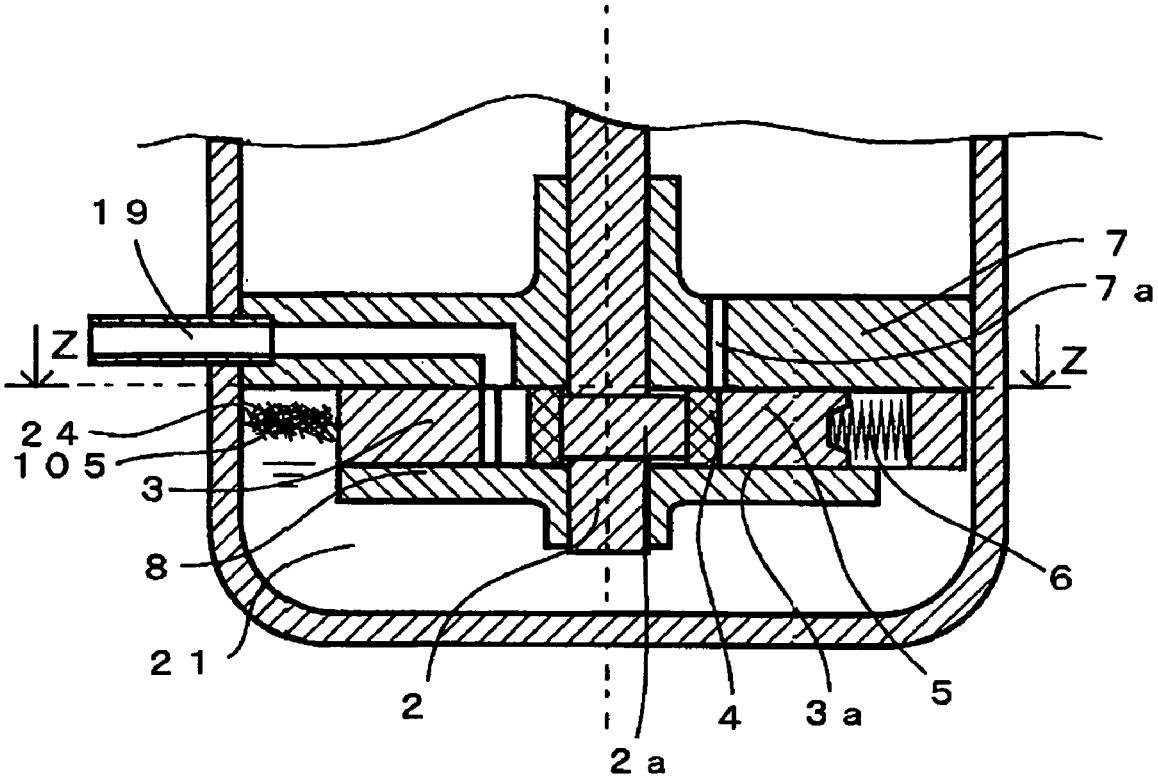
FIG. 7 is a vertical sectional view of an oil reservoir and its periphery of a refrigeration cycle of a fourth embodiment of the invention.
Figure 8:
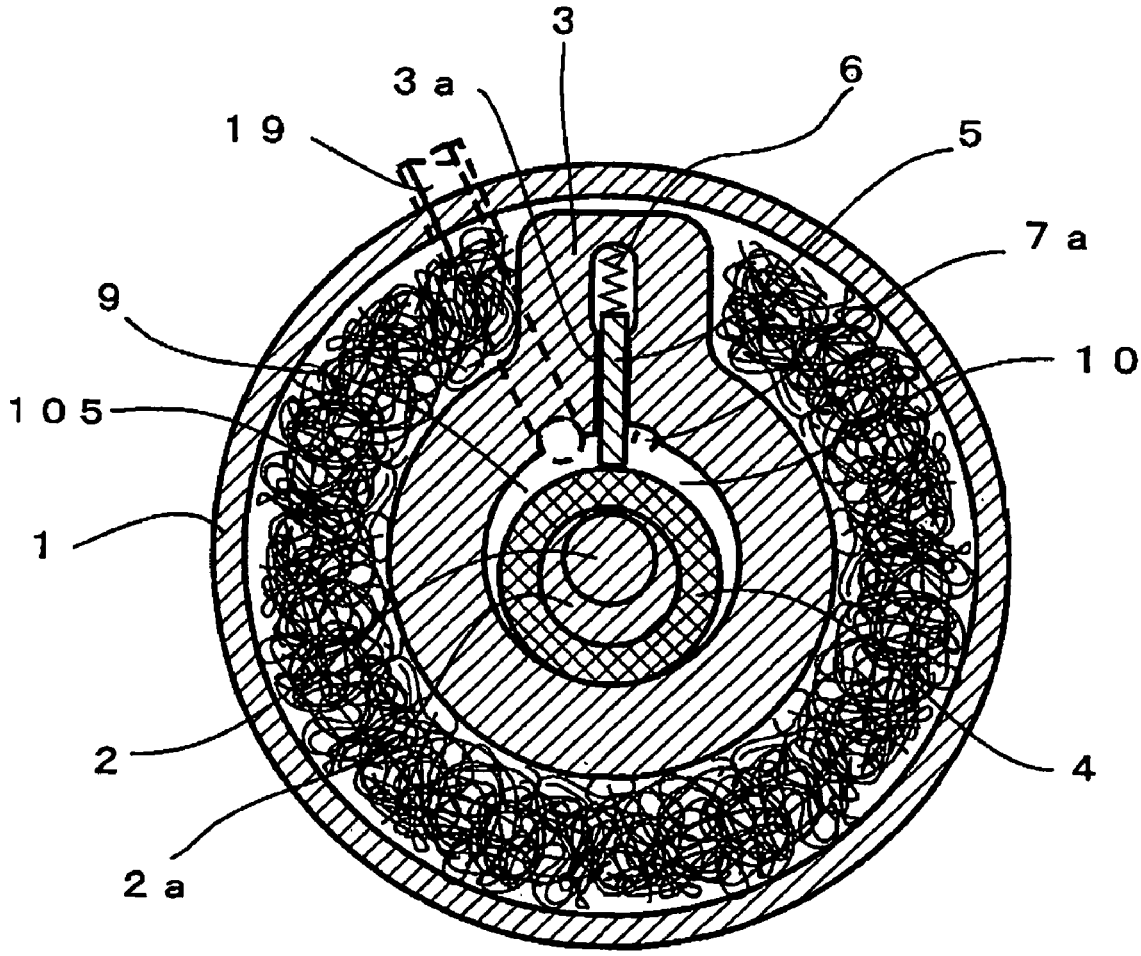
FIG. 8 is a transverse sectional view of the rotary compressor shown in FIG. 7 taken along the arrows Z-Z.

FIG. 7 is a vertical sectional view of an oil reservoir and its periphery of a refrigeration cycle of a fourth embodiment of the invention. FIG. 8 is a transverse sectional view of the rotary compressor shown in FIG. 7 taken along the arrows Z-Z.

The rotary compressor of this embodiment is different from that of the first embodiment in that a fibrous mesh member 105 floats as the floating type wave-suppressing members in the interface 24 between the working fluid and the refrigeration oil of the oil reservoir 21. That is, the bulk density of the fibrous mesh member 105 is greater than the density of the working fluid and smaller than the density of the refrigeration oil, the fibrous mesh member 105 floats astride the interface 24, and the interface 24 is located in the fibrous mesh member 105.

The operation of the rotary compressor having the above structure will be explained.

The main flow of working fluid which injected into the lower space 22 collides against the lower end surface 12*a* of the rotor 12, the lower balance weight 14 and a lower end 17*a* of the rivet 17 and then, generates a strong turning flow by the rotation of the rotor 12. A portion of oil drops mixed with the working fluid attaches to an inner wall of the container 1 due to the centrifugal force or falls downward by the gravity and is separated from the working fluid, and returns to the oil reservoir 21 while the working fluid stays in the lower space 22 as the turning flow.

On the other hand, the working fluid passes through the notch 11*e* and the gap 13 in a state in which the working fluid includes oil drops which are not yet separated, and is injected into the upper space 23 of the motor. The main flow of the injected working fluid flows toward the discharge pipe 20. At that time, a portion of working fluid passes in the vicinity of the upper end surface 12*b* of the rotor 12, the upper balance weight 15, an upper end 17*b* of the rivet 17 and a shaft projection 2*b* projecting from the upper end surface 12*b*, and becomes a turning flow due to influence of the rotation. A portion of the oil drops included in the working fluid attaches to the inner wall of the container 1 by the centrifugal force or falls downward by the gravity and is separated from the working oil and returns into the oil reservoir 21 along the inner wall of the container 1 or along the wall surface of the stator 11 while the working fluid stays in the upper space 23. And in a state in which the working fluid includes oil drops which are not yet separated from the working fluid, the working fluid is discharged from the discharge pipe 20.

According to the compressor of the fourth embodiment having such a structure, as the rotor 12 rotates, a turning flow of the working fluid is generated in the lower space 22. However, the fibrous mesh member 105 is disposed as the floating type wave-suppressing members in the interface 24 between the refrigeration oil and the working fluid and the interface 24 is located in the fibrous mesh member 105. Therefore, the turning flow of the working fluid is prevented from directly coming into contact with the interface 24 and thus, the influence of the turning flow can largely be suppressed.

When ripple is generated, since a portion of the fibrous mesh member 105 is immersed in the oil, the shearing force is generated in the vicinity of the surface of the fibrous mesh member 105, and the wave energy of the interface 24 is attenuated. Thus, the ripple of the oil reservoir 21 is suppressed, and the oil drops to be torn from the interface 24 by the turning flow can be reduced. With this, it is possible to prevent the oil drops of the refrigeration oil from being supplied to the working fluid from the interface 24, oil drops of refrigeration oil to be separated from the working fluid are reduced, and the oil discharging amount to be discharged from the container 1 can be reduced.

Since the fibrous mesh member 105 is used as the floating type wave-suppressing members in which the floating type wave-suppressing members are three-dimensionally intertwined with each other in a complicate manner, and it is possible to suppress the ripple irrespective of kinds of ripple such as vertical ripple and lateral ripple.

The fibrous mesh member 105 has the bulk densities greater than density of the working fluid and smaller than density of the refrigeration oil of the oil reservoir 21 so that a portion of the fibrous mesh member 105 is always immersed in the refrigeration oil of the oil reservoir 21 and is located in the interface 24. Therefore, the ripple-preventing effect of the interface 24 can always be exhibited. Generally, the density of the working fluid in the container 1 is varied depending upon the pressure and the temperature in the container 1, but if the variation range of the density of the working fluid is taken into account, the fibrous mesh member 105 can always be located in the interface 24.

Fifth Embodiment

A compressor of a fifth embodiment of the present invention is substantially the same as the rotary compressors of the first to fourth embodiments, and the same elements are designated with the same symbols. Explanation of the same structure and its operation will be omitted.

Figure 9:
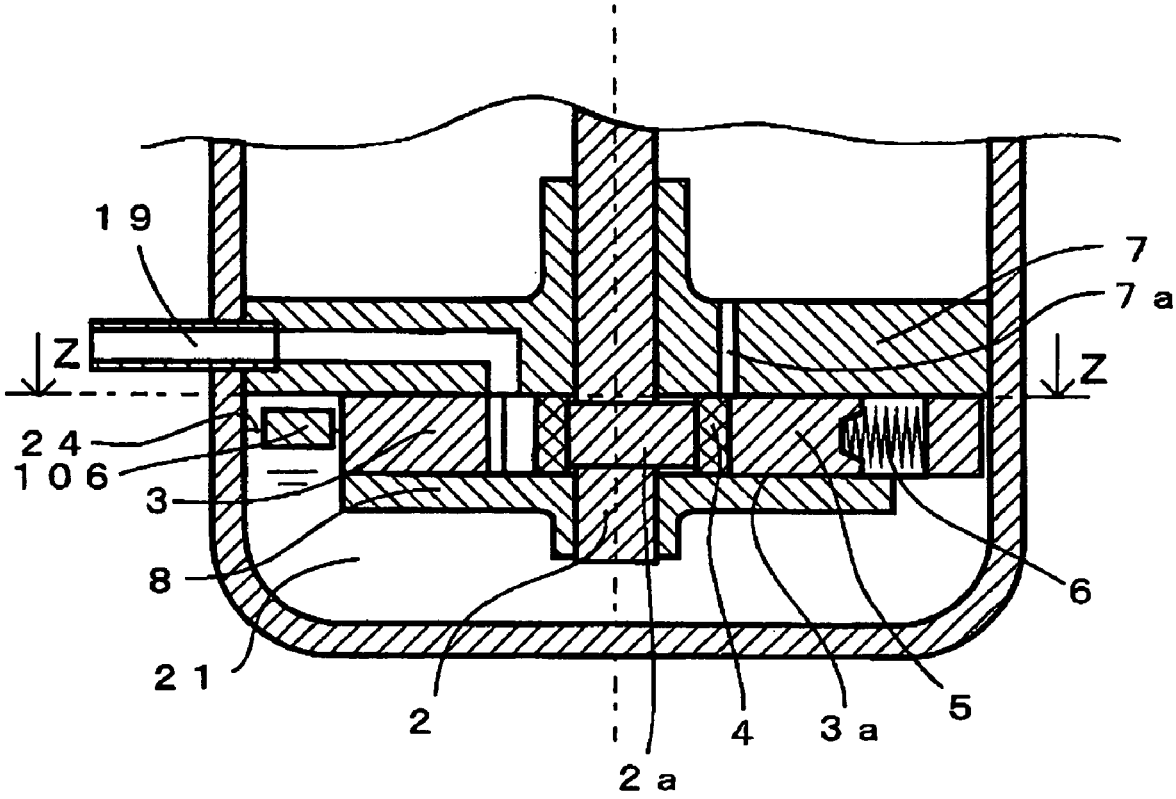
FIG. 9 is a vertical sectional view of an oil reservoir and its periphery of a refrigeration cycle of a fifth embodiment of the invention.
Figure 10:
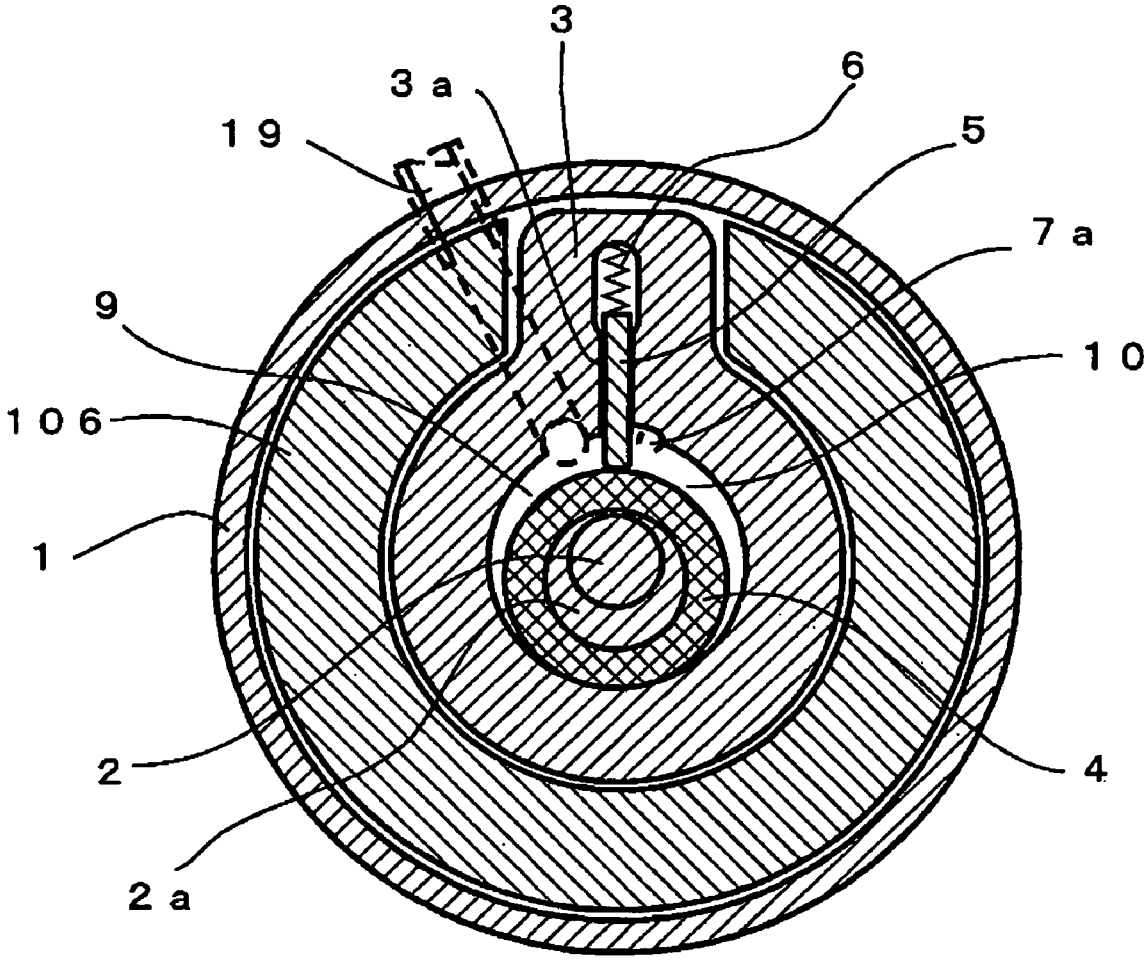
FIG. 10 is a transverse sectional view of the rotary compressor shown in FIG. 9 taken along the arrows Z-Z.

FIG. 9 is a vertical sectional view of an oil reservoir and its periphery of a refrigeration cycle of a fifth embodiment of the invention. FIG. 10 is a transverse sectional view of the rotary compressor shown in FIG. 9 taken along the arrows Z-Z.

The rotary compressor of the fifth embodiment is different from that of the first embodiment in that a plate member 106 floats as the floating type wave-suppressing members in the interface 24 between the working fluid and refrigeration oil of the oil reservoir 21. That is, the bulk density of the plate member 106 is greater than the density of the working fluid and smaller than the density of the refrigeration oil, and the plate member 106 floats astride the interface 24. The interface 24 is partially covered with the plate member 106.

The operation of the rotary compressor having the above structure will be explained.

The main flow of working fluid which injected into the lower space 22 collides against the lower end surface 12*a* of the rotor 12, the lower balance weight 14 and a lower end 17*a* of the rivet 17 and then, generates a strong turning flow by the rotation of the rotor 12. A portion of oil drops mixed with the working fluid attaches to an inner wall of the container 1 due to the centrifugal force or falls downward by the gravity and is separated from the working fluid, and returns to the oil reservoir 21 while the working fluid stays in the lower space 22 as the turning flow.

On the other hand, the working fluid passes through the notch 11*e* and the gap 13 in a state in which the working fluid includes oil drops which are not yet separated, and is injected into the upper space 23 of the motor. The main flow of the injected working fluid flows toward the discharge pipe 20. At that time, a portion of working fluid passes in the vicinity of the upper end surface 12*b* of the rotor 12, the upper balance weight 15, an upper end 17*b* of the rivet 17 and a shaft projection 2*b* projecting from the upper end surface 12*b*, and becomes a turning flow due to influence of the rotation. A portion of the oil drops included in the working fluid attaches to the inner wall of the container 1 by the centrifugal force or falls downward by the gravity and is separated from the working oil and returns into the oil reservoir 21 along the inner wall of the container 1 or along the wall surface of the stator 11 while the working fluid stays in the upper space 23. And in a state in which the working fluid includes oil drops which are not yet separated from the working fluid, the working fluid is discharged from the discharge pipe 20.

According to the compressor of the fifth embodiment having such a structure, as the rotor 12 rotates, a turning flow of the working fluid is generated in the lower space 22. However, the plate member 106 is disposed as the floating type wave-suppressing members in the interface 24 between the refrigeration oil and the working fluid and a portion of the interface 24 is covered with the plate member 106. Therefore, an area of the interface 24 with which the turning flow of the working fluid comes into direct contact with the interface 24 can be reduced and thus, the influence of the turning flow can largely be suppressed.

When ripple is generated, since the interface 24 is covered with the plate member 106, the wave energy of the interface 24 is absorbed as vertical motion energy of the plate member 106 and is attenuated. Thus, the ripple of the oil reservoir 21 is suppressed, and the oil drops to be torn from the interface 24 by the turning flow can be reduced. With this, it is possible to prevent the oil drops of the refrigeration oil from being supplied to the working fluid from the interface 24, oil drops of refrigeration oil to be separated from the working fluid are reduced, and the oil discharging amount to be discharged from the container 1 can be reduced.

The plate member 106 has the bulk densities greater than density of the working fluid and smaller than density of the refrigeration oil of the oil reservoir 21 so that a portion of the plate member 106 is always immersed in the refrigeration oil of the oil reservoir 21 and is located in the interface 24.

Therefore, the ripple-preventing effect of the interface 24 can always be exhibited. Generally, the density of the working fluid in the container 1 is varied depending upon the pressure and the temperature in the container 1, but if the variation range of the density of the working fluid is taken into account, the plate member 106 can always be located in the interface 24.

The effect of the first to fifth embodiment can be obtained irrespective of the kinds of the working fluid but especially when carbon dioxide is used as the working fluid, the effect can be enhanced.

That is, when the refrigeration cycle uses a working fluid mainly comprising carbon dioxide as a main ingredient, since the pressure of the working fluid discharged from the compression chamber exceeds a critical pressure, the working fluid in the container is brought into a supercritical state, an amount of refrigeration oil solved in the working fluid is increased, and a density ratio between the working fluid and the refrigeration oil is reduced by about half as compared with conventional flon or the like. Thus, the density difference with respect to the refrigeration oil is small, the ripple in the interface between the refrigeration oil and the working fluid by the turning flow of the working fluid becomes greater as compared with a case in which flon or the like is used, and an amount of oil drops torn from the interface by the flow of the working fluid and mixed into the working fluid is increased.

If the carbon dioxide and the compressor of any one of the first to fifth embodiments are combined, the ripple in the interface can be prevented and thus, it is possible to reduce the amount of oil discharged from the container. With this, there is a merit that it is possible to enhance the reliability of the compressor, and efficiency of the refrigeration cycle using this compressor can be enhanced, and carbon dioxide as environmentally friendly refrigerant can be used.

The bulk density of the floating type wave-suppressing members is set greater than the density of the working fluid and smaller than the density of the refrigeration oil of the oil reservoir in the above embodiments, but it is effective that hollow structures or independent small bubbles are provided in the floating type wave-suppressing members as bulk density adjusting means of course.

If a wave-suppressing member having a thickness including the variation range of the interface between the refrigeration oil and the working fluid in mind is fixed to the container or the compressor mechanism, the same effect can be obtained of course.

Although attention is given to the ripple of the interface between the working fluid and the refrigeration oil of the oil reservoir coming from the turning flow coming from rotation of the rotor in the above embodiments, the interface is rippled due to outside vibration or centrifugal force caused at the time of curving in the case of a vehicular compressor. The present invention is effective for preventing the oil drops of the refrigeration oil from being supplied to the working fluid from the interface by the ripple of course.

According to the present invention, since the wave-suppressing member is provided in the interface between the working fluid and the refrigeration oil of the oil reservoir, the ripple of the interface is suppressed. Thus, it is possible to prevent the oil drops from being scattered from the interface by the turning flow of the working fluid, and to reduce the supply of the oil drops of the refrigeration oil to the working fluid.

The wave-suppressing member is of the floating type, and the bulk density is set greater than the density of the working fluid and smaller than the density of the refrigeration oil. With this, the floating type wave-suppressing members can follow the vertical variation at a position of the interface, and the wave-suppressing member can move to a position where the wave-suppressing member itself can exhibit the oil drops scattering-preventing effect.

With this, it is possible to prevent the oil drops of the refrigeration oil from being mixed into the working fluid, and to reduce the amount of refrigeration oil to be taken out from the container, and it is possible to enhance the reliability and efficiency of the compressor and the refrigeration cycle using the compressor.

INDUSTRIAL APPLICABILITY

As described above, the present invention is suitably applied to a compressor having lubricant oil, i.e., refrigeration oil, and is suitable as a compressor used for refrigeration cycles such as a refrigerator-freezer, an air conditioner, a boiler, a vehicular air conditioner and the like.

The invention claimed is:

1. A compressor comprising:

a container;

a compressor mechanism, provided in a lower portion of said container, for compressing working fluid;

a motor, provided in an upper portion of said container, for driving said compressor mechanism to create a turning flow from the working fluid;

an oil reservoir, provided at a bottom of said container, for storing refrigeration oil; and a wave-suppressing member, provided to be floated in an interface between the working fluid and the stored refrigeration oil, and extended toward said compressor mechanism and extended toward said container, said wave-suppressing member comprising a divided member consisting of a plurality of plates which are partly immersed in the stored refrigeration oil and extend astride the interface to form a lattice which covers a substantial part of the interface area such that the interface area is divided into a plurality of pieces thereby reducing the rippling of the interface caused by the turning flow directly contacted with the interface.

2. A compressor comprising:

a container;

a compressor mechanism, provided in a lower portion of said container, for compressing working fluid;

a motor, provided in an upper portion of said container, for driving said compressor mechanism to create a turning flow from the working fluid;

an oil reservoir, provided at a bottom of said container, for storing refrigeration oil; and a floating type wave-suppressing member, floated in an interface between the working fluid and the refrigeration oil of said reservoir, for reducing the area of said interface which comes into direct contact with a turning flow of the working fluid generated by the rotation of the rotor;

wherein said wave-suppressing member comprises a divided member which extends toward said compressor mechanism and extends toward said container to divide said interface into a plurality of pieces, wherein said divided member comprises a mesh member and portions of said mesh member are always immersed in the refrigeration oil of said reservoir.

* * * * *